US012714947B2

(12) United States Patent
Sakai

(10) Patent No.: US 12,714,947 B2
(45) Date of Patent: Aug. 25, 2026

(54) CREATION TABLE FOR FUSIBLE TOY BEAD

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 217 days.

(21) Appl. No.: 18/650,678

(22) Filed: Apr. 30, 2024

(65) Prior Publication Data

US 2024/0367070 A1 Nov. 7, 2024

(30) Foreign Application Priority Data

May 1, 2023 (JP) ..... 2023-075456

(51) Int. Cl.
*A63H 33/14* (2006.01)
*A63H 33/00* (2006.01)
*A63H 33/06* (2006.01)

(52) U.S. Cl.
CPC ..... *A63H 33/001* (2013.01); *A63H 33/06* (2013.01); *A63H 33/14* (2013.01)

(58) Field of Classification Search
CPC ..... A63H 33/00; A63H 33/001; A63H 33/06; A63H 33/14
USPC ..... 446/85, 86, 87
See application file for complete search history.

(56) References Cited

U.S. PATENT DOCUMENTS 5,098,676 A * 3/1992 Brooks, Jr. ..... A61L 2/26 422/550
5,704,789 A * 1/1998 Yang ..... G09B 11/00 434/96
8,870,185 B2 * 10/2014 Cheng ..... A63F 3/00003 273/281

(Continued)

FOREIGN PATENT DOCUMENTS

CN 201052418 Y * 4/2008
JP 2005034429 A * 2/2005

(Continued)

OTHER PUBLICATIONS

British Search Report issued Oct. 8, 2024 in Application No. GB2406106.1.

(Continued)

*Primary Examiner* — Alexander R Niconovich
(74) *Attorney, Agent, or Firm* — Faegre Drinker Biddle & Reath LLP

(57) ABSTRACT

A creation table for fusible toy bead includes: a first table having through holes and configured to allow a fusible toy bead to be placed; and a second table including pins configured to be inserted into and removed from the through holes. The first table is configured to be stacked on the second table in a first direction along a normal direction of the second table such that the pins are inserted into the through holes. The first table includes a protruding portion protruding in the first direction. The second table includes a lug portion connected via a hinge so as to be foldable in the first direction. The lug portion is engaged with the protruding portion by folding the lug portion in the first direction in a state where the first table is stacked on the second table.

6 Claims, 6 Drawing Sheets

(56) References Cited

U.S. PATENT DOCUMENTS

| | | | | |
|---|---|---|---|---|
| 9,375,634 | B2 * | 6/2016 | Kamiyama | A63F 9/06 |
| 9,956,495 | B2 * | 5/2018 | Kamiyama | A63F 9/06 |
| 10,279,278 | B2 * | 5/2019 | Sakai | A63F 9/06 |
| 10,478,740 | B2 * | 11/2019 | Sakai | A63H 33/001 |
| 10,898,821 | B2 * | 1/2021 | Poulus | A63H 33/086 |
| 12,311,282 | B2 * | 5/2025 | Robbins | A63H 33/14 |
| 2012/0186748 | A1 * | 7/2012 | Kamiyama | A63H 9/00 156/349 |
| 2014/0120501 | A1 * | 5/2014 | Cooke | B44C 3/123 434/81 |
| 2016/0271510 | A1 * | 9/2016 | Ho | A63H 33/14 |
| 2017/0087480 | A1 * | 3/2017 | Poulus | A63H 33/086 |
| 2018/0043276 | A1 * | 2/2018 | Sakai | A63H 33/14 |
| 2018/0333653 | A1 | 11/2018 | Sakai | |
| 2019/0336880 | A1 | 11/2019 | Sakai | |
| 2020/0094131 | A1 * | 3/2020 | Sakai | A63F 9/06 |
| 2021/0283522 | A1 | 9/2021 | Sakai | |
| 2024/0238687 | A1 * | 7/2024 | Sakai | A63H 33/00 |
| 2024/0238690 | A1 * | 7/2024 | Sakai | A63H 33/086 |
| 2024/0367068 | A1 * | 11/2024 | Sakai | A63H 33/001 |
| 2024/0367070 | A1 * | 11/2024 | Sakai | A63H 33/06 |

FOREIGN PATENT DOCUMENTS

| | | | | |
|---|---|---|---|---|
| JP | 3722815 | B2 | 11/2005 | |
| JP | 2011139820 | A * | 7/2011 | |
| JP | 2018-191839 | A | 12/2018 | |
| JP | 2024160456 | A * | 11/2024 | B25H 1/12 |

OTHER PUBLICATIONS

Spanish Search Report issued Apr. 14, 2025 in Application No. P202430342.

French Search Report issued Jan. 21, 2026 in Application No. 2404515.

* cited by examiner

CREATION TABLE FOR FUSIBLE TOY BEAD

CROSS-REFERENCE TO RELATED APPLICATIONS

This application is based on and claims priority under 35 USC 119 from Japanese Patent Application No. 2023-075456 filed on May 1, 2023, the contents of which are incorporated herein by reference.

TECHNICAL FIELD

The present disclosure relates to a creation table for fusible toy bead.

BACKGROUND ART

JP2018-191839A discloses a creation table for fusible toy bead allowing an assembly of fusible toy beads placed on the creation table for fusible toy bead to be removed before completely dried out so as to create a next assembly of fusible toy beads. The creation table for fusible toy bead includes a table on which fusible toy beads are arranged, and a receiver to be inverted together with the table and including a receiving surface that receives, moves, and dries the arranged fusible toy beads. In the creation table for fusible toy bead, when creating an assembly of fusible toy beads, water is applied to the fusible toy beads, and then a receiver is disposed on the table.

SUMMARY OF INVENTION

In the creation table for fusible toy bead disclosed in JP2018-191839A, ear-shaped stationary handles are provided on both sides of an outer edge of the receiver so that the receiver can be easily disposed on the table. Due to the stationary handles provided on the outer edge of the receiver or the table, a width dimension of the receiver or the table becomes large even when the creation table for fusible toy bead is not used, and a space of the creation table for fusible toy bead cannot be saved.

An object of the present disclosure is to provide a creation table for fusible toy bead capable of saving space.

The present disclosure provides a creation table for fusible toy bead including: a first table having a plurality of through holes extending in a penetration direction and configured to allow a fusible toy bead to be placed on one side of the plurality of through holes in the penetration direction; and a second table including a plurality of pins configured to be inserted into and removed from the plurality of through holes from another side of the plurality of through holes in the penetration direction, in which: the first table is configured to be stacked on the second table in a first direction along a normal direction of the second table such that the plurality of pins are inserted into the plurality of through holes, the first table including at least one protruding portion protruding in the first direction; the second table includes at least one lug portion connected via a hinge so as to be foldable in the first direction; and the at least one lug portion is engaged with the at least one protruding portion by folding the at least one lug portion in the first direction in a state where the first table is stacked on the second table.

According to the present disclosure, it is possible to provide a creation table for fusible toy bead capable of saving space.

BRIEF DESCRIPTION OF DRAWINGS

The present disclosure will be described in detail based on the following without being limited thereto, wherein.

DESCRIPTION OF EMBODIMENTS

Figure 1:
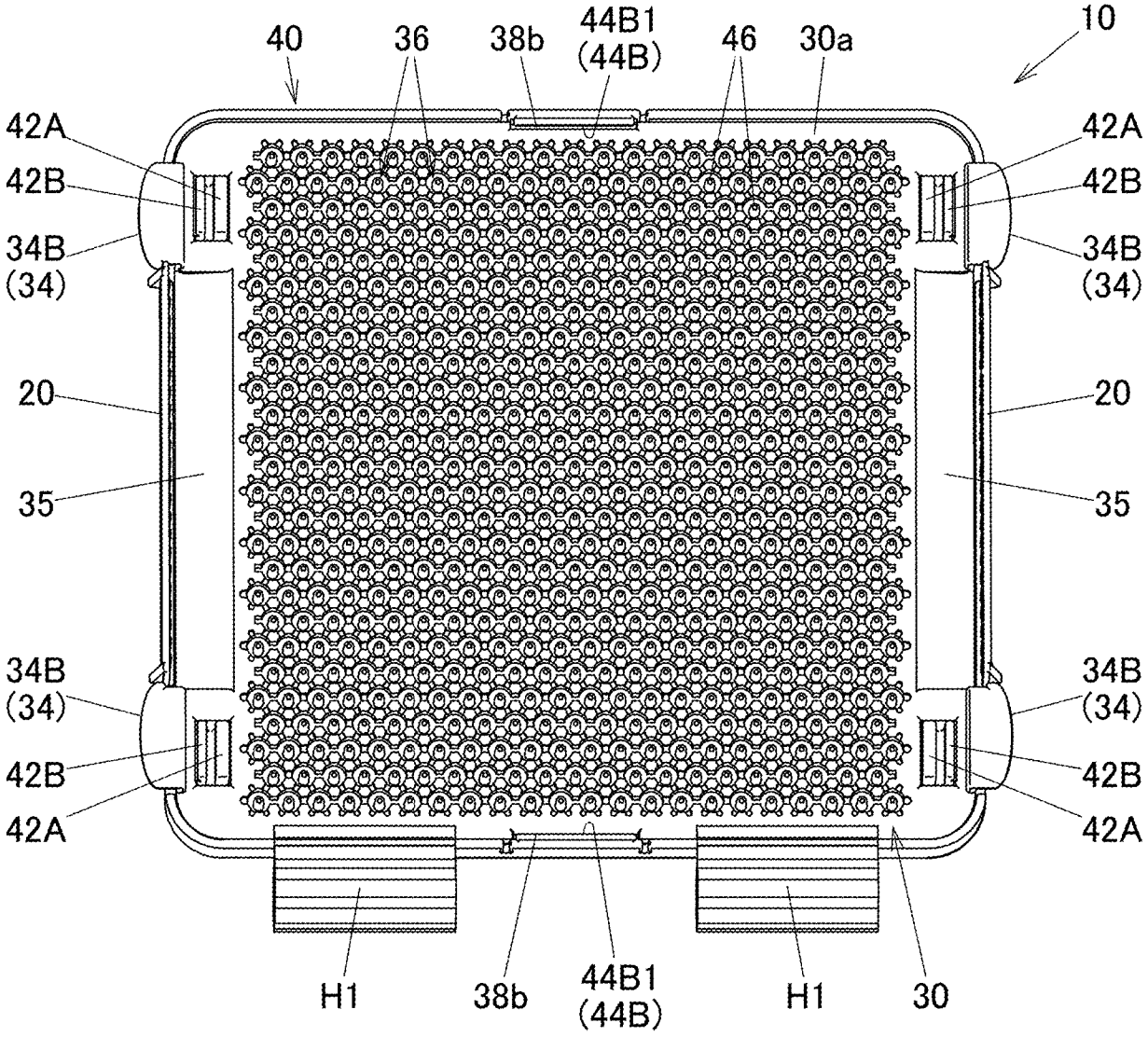
FIG. 1 is a perspective view of a creation table for fusible toy bead according to an embodiment of the present disclosure as viewed from above.
Figure 2:
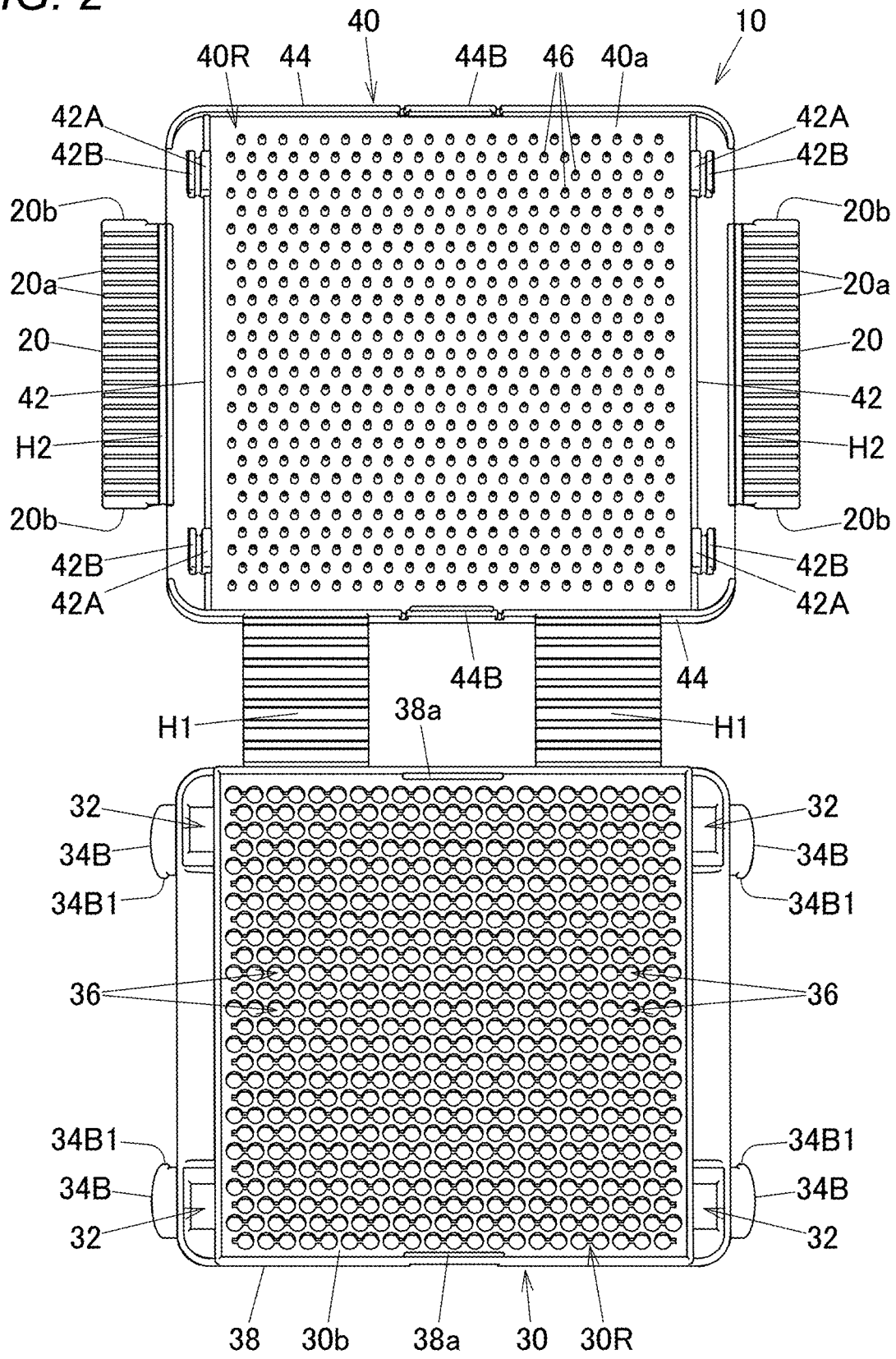
FIG. 2 is a perspective view of the creation table for fusible toy bead according to the embodiment of the disclosure with a first table opened and viewed from above.

An embodiment of the present disclosure will be described with reference to the drawings. As shown in FIGS. 1 and 2, a creation table for fusible toy bead (a fusible toy bead creation table) 10 according to the embodiment of the present disclosure includes a first table 30 and a second table 40. The first table 30 is connected to the second table 40 via a pair of first hinges H1. The fusible toy bead creation table 10 is formed by injection molding of a resin material, and the first table 30 and the second table 40 are formed in a plate shape.

The first table 30 has a substantially square first table region 30R, and the second table 40 has a substantially square second table region 40R. The first table 30 and the second table 40 are formed in substantially the same size. The first table region 30R and the second table region 40R are also formed in substantially the same size. The first table 30 is stacked on the second table 40 by bending the pair of first hinges H1.

Hereinafter, a state in which the pair of first hinges H1 are bent and the first table 30 is stacked on the second table 40 is referred to as a "closed state of the first table 30", and a state in which the first table 30 is separated from the second table 40 without bending the pair of first hinges H1 is referred to as an "opened state of the first table 30". In the following description, a side on which the first table 30 overlaps the second table 40 is referred to as an upper side, and an opposite side thereof is referred to as a lower side; a side on which the first hinges H1 are provided when the fusible toy bead creation table 10 is viewed from above is referred to as a front side, and an opposite side thereof is referred to as a rear side; and a right side when the fusible toy bead creation table 10 is viewed from the front side is referred to as a right side, and the opposite side thereof is referred to as a left side.

A plurality of fusible toy beads can be placed on an upper surface 30*a* of the first table 30. The fusible toy bead creation table 10 is a toy that is played by arranging the plurality of fusible toy beads according to various designs or the like and combining the fusible toy beads to each other by spraying water with a sprayer or the like. Sheet holding plates 48A and sheet holding ribs 48B to be described later are provided on a lower surface 40*b* of the second table 40 (see FIG. 4), so that a sheet, such as paper, on which a design and the like are illustrated can be held. The design on the sheet held by the sheet holding plates 48A and the sheet holding ribs 48B can be seen from above the first table 30 through the second table 40 and the first table 30. Accordingly, a user can arrange the fusible toy bead according to the design on the sheet held by the sheet holding plates 48A and the sheet holding ribs 48B.

The fusible toy bead placed on the first table 30 is made of a resin, which is a water-soluble material. Specifically, the fusible toy bead is made by blending polyvinyl alcohol with a resin and kneading them. The resin forming the fusible toy bead can be formed by appropriately selecting a transparent material, a translucent material, or an opaque material. The fusible toy bead may be in various shapes such as a spherical shape or a polygonal shape.

First, the configuration of the second table 40 will be described. As shown in FIG. 2, in the second table 40, both left and right sides of the second table region 40R which has a substantially square shape protrude outward, and the ear-shaped lug portions 20 are respectively provided at substantially central portions in a front-rear direction of outer edges of the protruding portions via second hinges H2. Each of the lug portions 20 has a substantially rectangular plate shape elongated in the front-rear direction, and can be folded upward (first direction, a direction along the normal direction of the second table 40) via the second hinge H2. Each of the second hinges H2 has a thin portion along the bending line, so that each lug portion 20 can be folded.

On both left and right sides of the upper surface 40*a* of the second table region 40R, upper surface first low wall portions 42 each having a low wall height are provided along the front-rear direction. The upper surface first low wall portions 42 are provided with plate guides 42A along the upper surface first low wall portions 42. Two plate guides 42A are provided on each of the two upper surface first low wall portions 42 at a predetermined interval in the front-rear direction along the upper surface first low wall portions 42, for a total of four plate guides 42A. A plate thickness of the plate guide 42A is slightly larger than a thickness of the upper surface first low wall portion 42. An inner wall surface of the plate guide 42A is continuous with an inner surface of the upper surface first low wall portion 42, and is flush with the inner surface.

A guide plate spring 42B is provided on an outer side of each plate guide 42A at a predetermined interval from the plate guide 42A in the left-right direction. The guide plate spring 42B is provided parallel to the plate guide 42A, and has a plate thickness substantially equal to the thickness of the upper surface first low wall portion 42. The guide plate spring 42B is formed in a tapered shape whose plate thickness gradually decreases from a base end toward the upper side, and has a spring property. A spring protrusion 42B1 slightly protruding outward is provided on an upper portion of an outer surface of each guide plate spring 42B (see FIG. 3).

On the upper surface 40*a* of the second table region 40R, upper surface second low wall portions 44 each having a lower wall are provided along the left-right direction on a pair of two sides facing each other in the front-rear direction. A height of the upper surface second low wall portion 44 is higher than the height of the upper surface first low wall portion 42, and is lower than a height of the plate guide 42A and the guide plate spring 42B (see FIG. 3). Substantially plate-shaped regulating plate springs 44B formed to have spring properties are provided at substantially central portions in the left-right direction of the upper surface second low wall portions 44. Each regulating plate spring 44B is provided along the left-right direction with both plate surfaces facing in the front-rear direction. A regulating protrusion 44B1 slightly protruding inward in a hook shape is provided on an upper portion of an inner surface of each regulating plate spring 44B (see FIG. 3).

The pair of first hinges H1 are provided on the front side of the second table 40 at a predetermined interval in the left-right direction. Each first hinge H1 is connected to an outer wall surface of the front upper surface second low wall portion 44. Each first hinge H1 is formed in a bellows-shaped substantially rectangular sheet shape in which thin portions and thick portions are alternately provided in a connection direction, and is flexible. In the opened state of the first table 30, both first hinges H1 are in a posture with both sheet surfaces facing in an upper-lower direction. A plurality of pins 46 rising upward are provided on the upper surface 40*a* of the second table 40. The plurality of pins 46 are arranged in a staggered rows and columns. Each pin 46 is formed in a substantially truncated cone shape with a reduced diameter on the upper side.

Figure 3:
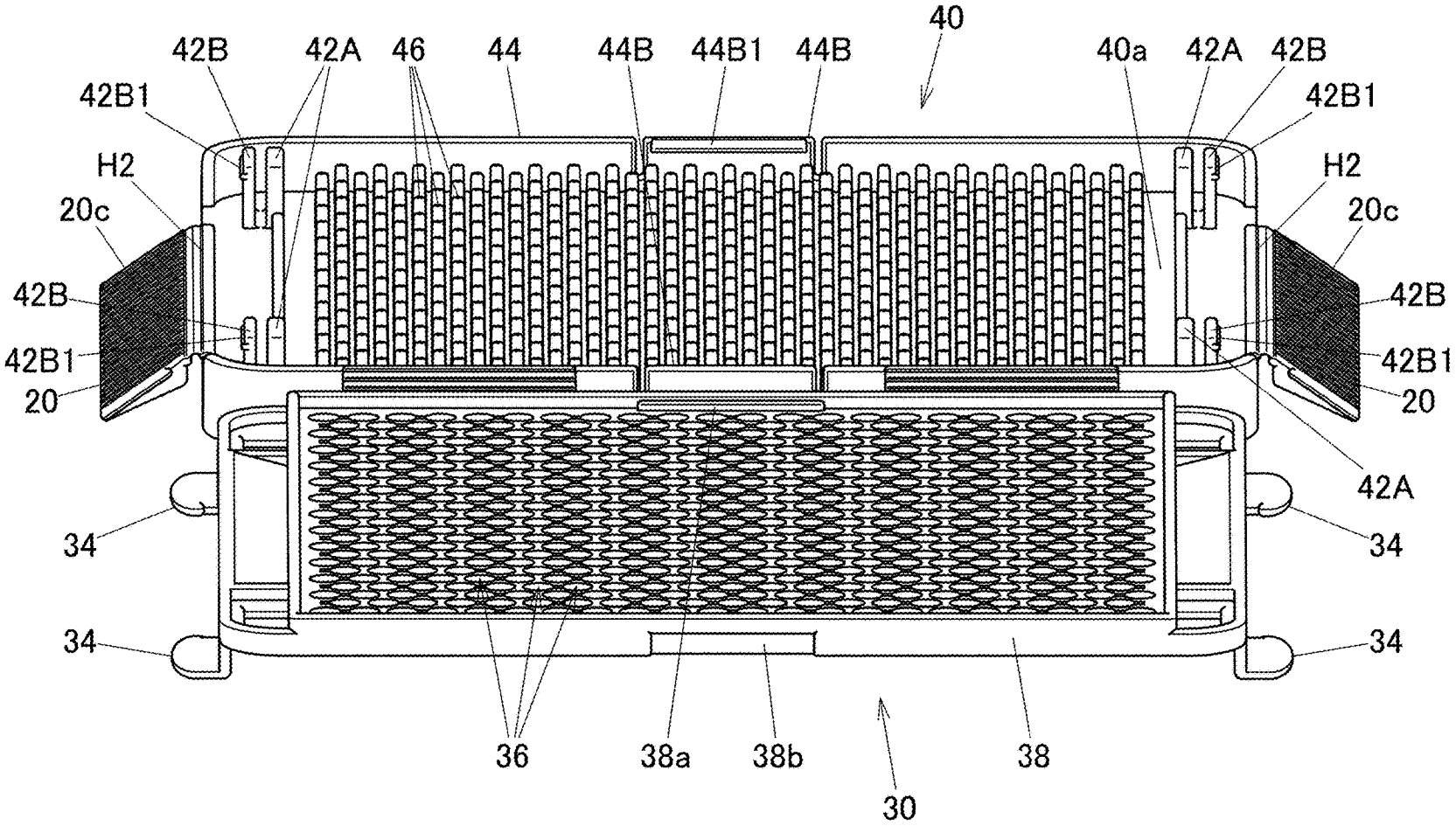
FIG. 3 is a perspective view of the creation table for fusible toy bead according to the embodiment of the disclosure with the first table opened and viewed from an upper front side.
Figure 5:
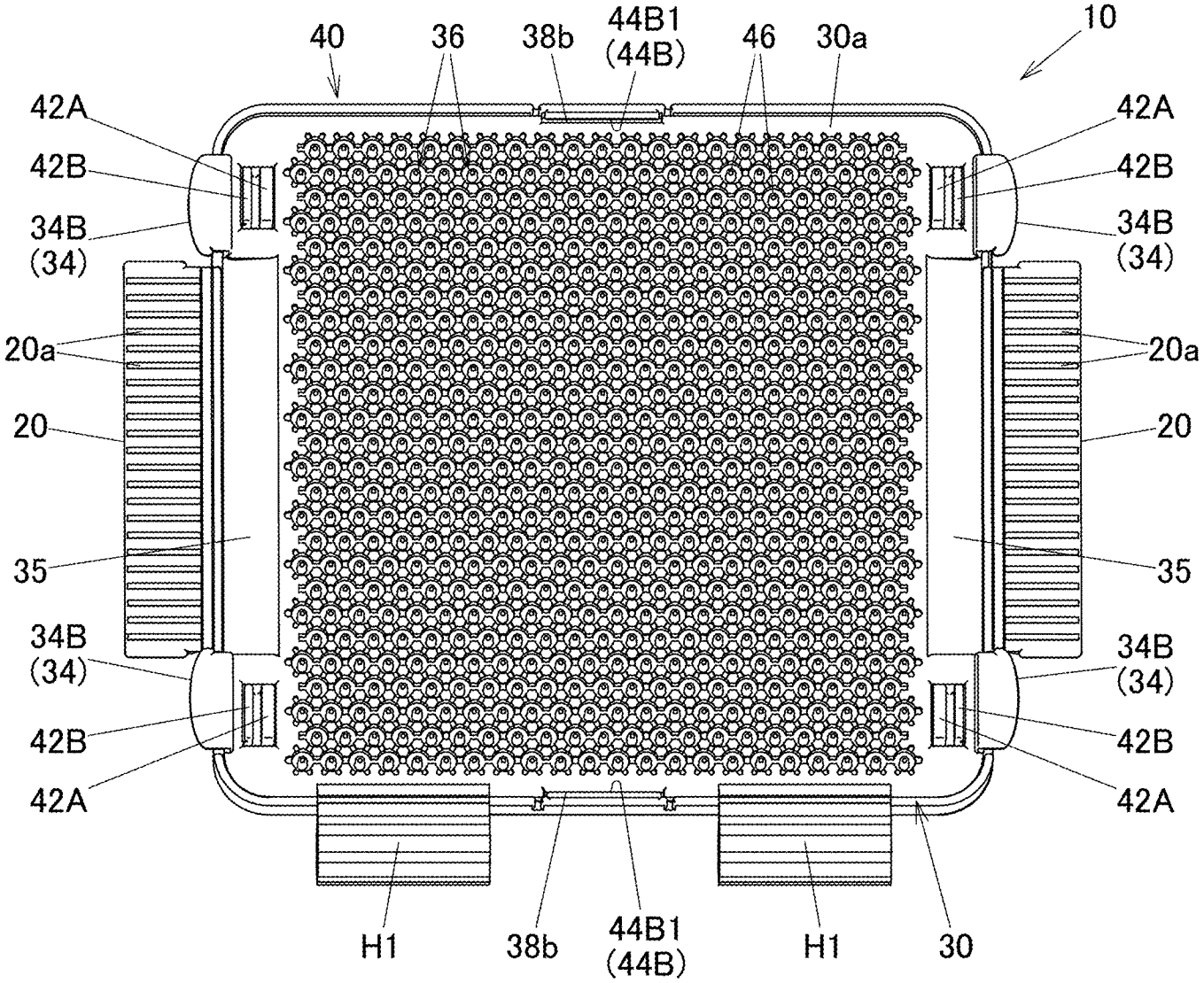
FIG. 5 is a perspective view of the creation table for fusible toy bead according to the embodiment of the disclosure with lug portions opened and viewed from above.

As shown in FIGS. 2 and 5, each lug portion 20 of the second table 40 is provided with a plurality of ribs 20*a* extending linearly along the left-right direction at equal intervals in the front-rear direction. In addition, engagement overhang portions 20*b* that protrude slightly outward are provided at both front and rear end portions of each lug portion 20, respectively. As shown in FIG. 3, in a state where each lug portion 20 is not folded (opened state), an upper surface of each lug portion 20 defines a lug portion-side inclined surface (inclined surface) 20*c* that is inclined from a region where the plurality of pins 46 of the second table 40 are provided to an installation surface on which the second table 40 is installed.

Next, the configuration of the first table 30 will be described. The upper surface 30*a* faces upward in the closed state of the first table 30 (see FIG. 1). Accordingly, in the opened state of the first table 30 (see FIG. 2), the upper surface 30*a* of the first table 30 faces downward and a lower surface 30*b* faces upward. In the first table 30, both left and right sides of the substantially square first table region 30R overhang outward, and guide holes 32, each of which is a rectangular through hole elongated in the front-rear direction, are provided at four corners of the overhanging portion.

Figure 4:
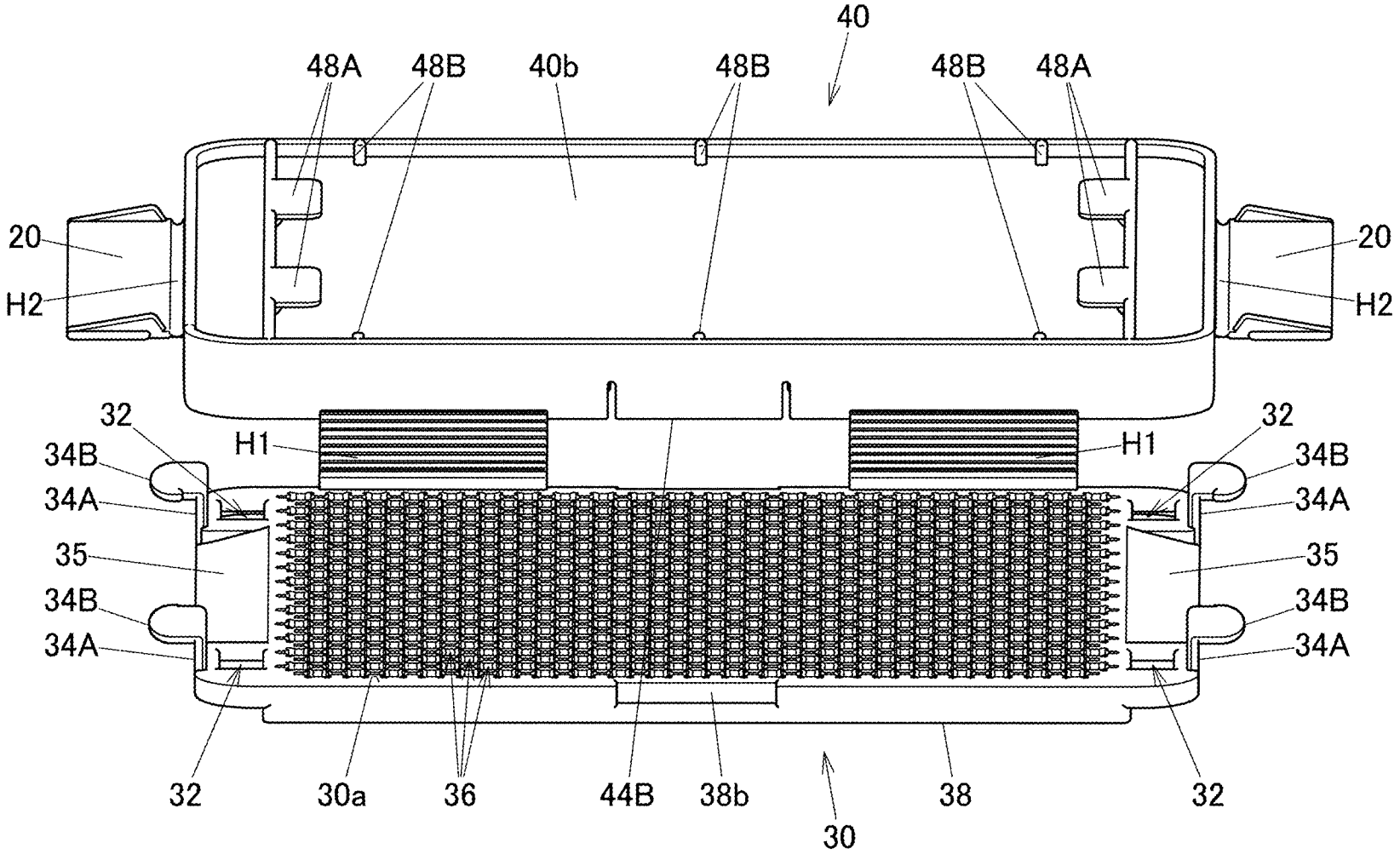
FIG. 4 is a perspective view of the creation table for fusible toy bead according to the embodiment of the disclosure with the first table opened and viewed from a lower front side.

As shown in FIG. 4, a protruding portion 34 protruding upward in a wall shape is provided on the outside of each guide hole 32. Each protruding portion 34 includes a rising portion 34A that rises in a wall shape with a wall surface facing in the left-right direction (a third direction), and an overhang portion 34B that is folded outward at a substantially right angle from a tip end of each rising portion 34A and overhangs in a substantially plate shape. A tip end of each overhang portion 34B has a substantially arc shape. As shown in FIGS. 2 and 4, engagement protrusions 34B1 that protrude inward in the front-rear direction (second direction) and are to be engaged with the lug portions 20 of the second table 40 are provided at the tip ends of the overhang portions 34B.

A first table-side inclined surface 35 is provided between each two of the four guide holes 32 arranged in the front-rear direction. Each first table-side inclined surface 35 is formed to be inclined outward from the upper surface 30*a* to the lower surface 30*b* of the first table 30. When the first table 30 is stacked on the second table 40, the lug portions 20 are not folded, so that the first table-side inclined surface 35 and the lug portion-side inclined surface 20*c* are connected to each other, and a continuous inclined surface is formed from both left and right sides of the first table region 30R to the installation surface.

The first table 30 is provided with a plurality of through holes 36 that are open in a circular shape and whose penetration direction is the upper-lower direction. In the closed state of the first table 30, each through hole 36 is provided at a position overlapping with each pin 46 provided on the second table 40 in the upper-lower direction (see FIG. 1). Accordingly, the through holes 36 are arranged in a staggered rows and columns. The opening of each through hole 36 is sized to allow each pin 46 to be inserted therethrough. In other words, each pin 46 is formed so as to be inserted into and removed from each through hole 36. An opening diameter of each through hole 36 is slightly smaller than a diameter of the fusible toy bead. Therefore, the fusible toy bead can be placed on an opening edge of each through hole 36.

As shown in FIG. 2, a wall-shaped edge wall 38 is provided on the lower surface 30*b* of the first table 30 and extends downward along an outer edge of the first table region 30R. Stepped convex portions 38*a* protruding inward are provided at substantially central portions in the left-right direction of two inner wall surfaces of the edge wall 38 that face each other in the front-rear direction, so as to form a step between the lower surface 30*b* of the first table 30 and the stepped convex portion 38*a*. A stepped concave portion 38*b* that is recessed with a step is provided at a portion of the upper surface 30*a* of the first table 30 corresponding to each of the stepped convex portions 38*a* (see FIGS. 3 and 4). The pair of first hinges H1 described above are connected to an outer edge portion of the upper surface of the first table 30 on both sides of one stepped concave portion 38*b*.

As shown in FIG. 1, the first table 30 and the second table 40 can be combined with each other by bending the pair of first hinges H1, stacking the lower surface 30*b* of the first table 30 on the upper surface 40*a* of the second table 40, and inserting the guide plate springs 42B and the plate guides 42A through the guide holes 32. An opening edge of the guide hole 32 is guided in proximity to or in contact with an inner side surface of the plate guide 42A and an outer side surface of the guide plate spring 42B. In other words, the guide holes 32, the guide plate springs 42B, and the plate guides 42A guide the first table 30 and the second table 40 in the upper-lower direction so that they can approach and separate from each other.

As shown in FIG. 1, an upward movement of the first table 30 is regulated by each stepped concave portion 38*b* being engaged with each regulating plate spring 44B and in contact with the regulating protrusion 44B1. The first table 30 is configured such that the guide holes 32 are positioned above the spring protrusions 42B1 of the guide plate springs 42B when the guide plate springs 42B and the plate guides 42A are inserted into the guide holes 32 and before the stepped concave portions 38*b* come into contact with the regulating protrusions 44B1. In this state, the spring protrusions 42B1 come into contact with an edge portion of the guide hole 32, so that a state is maintained in which the first table 30 and the second table 40 are separated from each other by a predetermined interval in the upper-lower direction, and each pin 46 is removed from each through hole 36.

Figure 6:
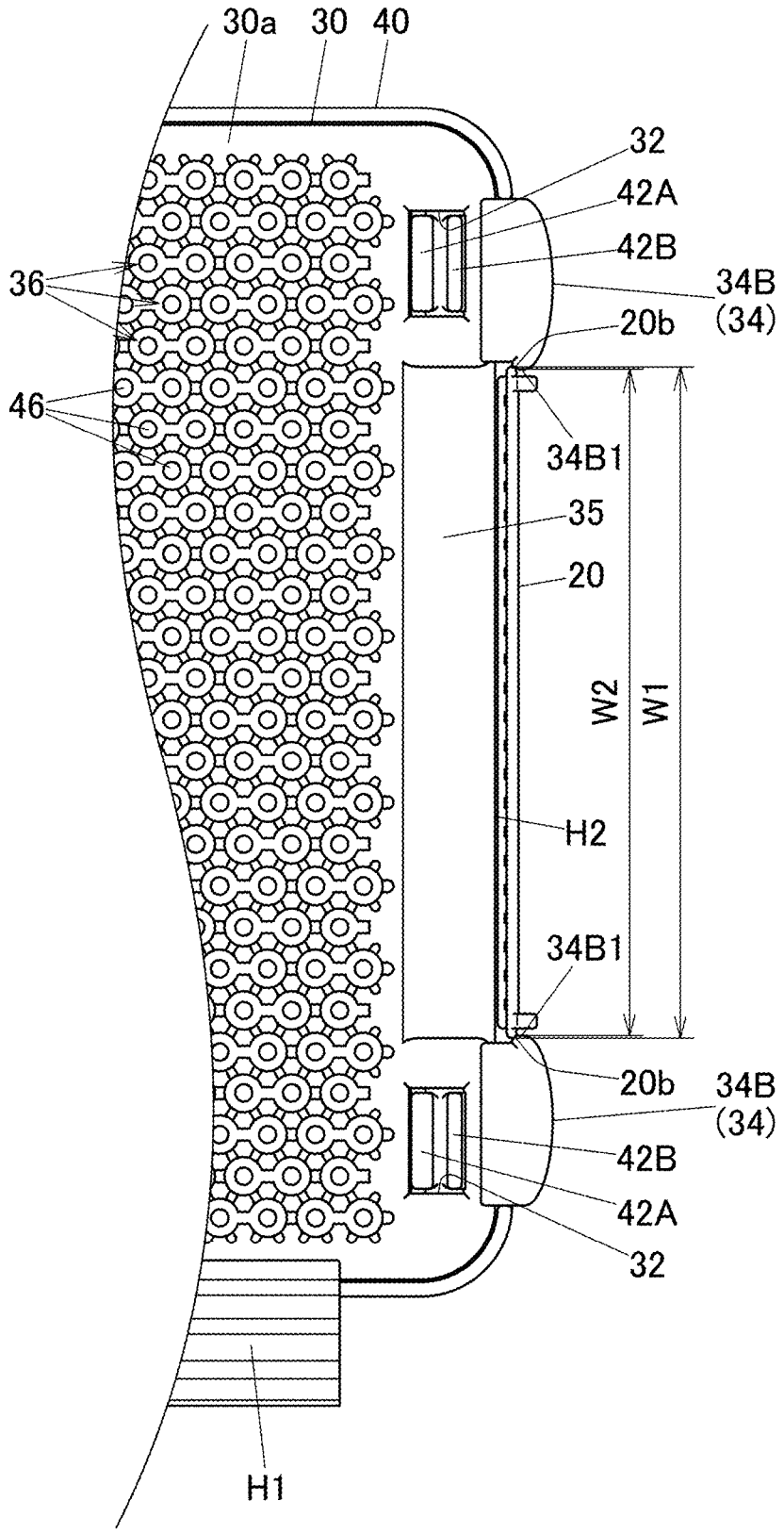
FIG. 6 is an enlarged perspective view of the vicinity of the lug portion on one side of the creation table for fusible toy bead according to the embodiment of the disclosure as viewed from above.

Next, an engagement mode between each lug portion 20 of the second table 40 and each protruding portion 34 of the first table 30 will be described. As shown in FIG. 6, each lug portion 20 can be folded upward at a substantially right angle with respect to the upper surface 40*a* of the second table 40. In a state where the first table 30 is stacked on the second table 40 and each lug portion 20 is folded at a substantially right angle, the height of the engagement overhang portion 20*b* of each lug portion 20 is substantially equal to the height of the engagement protrusion 34B1 of each protruding portion 34.

Further, a width W1 between the engagement overhang portions 20*b* provided on both front and rear sides of each lug portion 20 is slightly larger than a width W2 between the engagement protrusions 34B1 of each protruding portion 34 arranged in the front-rear direction. Therefore, when each lug portion 20 is folded at a substantially right angle, each engagement overhang portion 20*b* is engaged with each protruding portion 34, and the lug portion 20 is engaged with the protruding portion 34. The engagement between the lug portion 20 and the protruding portion 34 is easily released by applying a force in a direction of opening the lug portion 20 outward.

Next, a method of creating an assembly of fusible toy beads using the fusible toy bead creation table 10 will be described. If the lug portion 20 and the protruding portion 34 are engaged with each other, the engagement between the two is released in advance. First, the first table 30 is stacked on the second table 40, the first table 30 and the second table 40 are separated from each other by a predetermined interval in the upper-lower direction, and each pin 46 is removed from each through hole 36. In this state, the sheet holding plates 48A and the sheet holding ribs 48B of the second table 40 hold a sheet on which any design is illustrated. Next, among the through holes 36 of the first table 30, a plurality of fusible toy beads are placed on the through holes 36 (through holes 36 overlapping the design) corresponding to the design illustrated on the sheet.

In a state where the fusible toy bead is placed on the through hole 36, a tip end of the pin 46 and the fusible toy bead are not in contact with each other and are separated from each other. After a plurality of fusible toy beads are placed, water is sprayed onto the plurality of fusible toy beads using a sprayer or the like. The water sprayed onto the first table 30 is stored on the second table 40 through the through hole 36 and the like, the water hardly overflows and falls from a surface of the first table 30 to the outside of the fusible toy bead creation table 10. The wet and unnecessary fusible toy beads can be rolled on the first table-side inclined surface 35 and the lug portion-side inclined surface 20*c* and moved to the installation surface, and can be effectively dried on the installation surface. At this time, the ribs 20*a* provided on the lug portion 20 allow the wet fusible toy beads to easily roll on the lug portion-side inclined surface 20*c*.

Next, when the first table 30 is pushed toward the second table 40 side by pushing the overhang portions 34B downward with both hands or the like, the first table 30 approaches the second table 40. At this time, the guide plate spring 42B springs and warps toward the plate guide 42A at the edge of the guide hole 32 that comes into contact with the spring protrusion 42B1. Accordingly, the guide hole 32 can pass over the spring protrusion 42B1. When the guide hole 32 passes over the spring protrusion 42B1, a tip end (lower end) of the edge wall 38 comes into contact with the upper surface 40*a* of the second table 40, and a downward movement of the first table 30 is regulated.

When the tip end portion of the edge wall 38 comes into contact with the upper surface 40*a* of the second table 40, a tip end of each pin 46 passes through each through hole 36 and comes into contact with a fusible toy bead from below, and the fusible toy bead is relatively pushed up with respect to an upper opening edge of each through hole 36. The fusible toy bead is separated from the upper opening edge of each supported through hole 36 for supporting, and the support by each through hole 36 is released. At this time, the plurality of fusible toy beads are connected to such an extent that they can be held by a hand. Therefore, the plurality of fusible toy beads, which are no longer supported by the through holes 36 and are supported by the tip ends of the pins 46, are lifted by the hand and removed from the fusible toy bead creation table 10, and an assembly of the fusible toy beads is completed.

As described above, when the fusible toy bead creation table 10 according to the embodiment of the present disclosure is not used, the lug portions 20 are folded upward at a substantially right angle with respect to the second table 40 and engaged with the protruding portions 34, so that the lug portions 20 can be prevented from protruding from both left and right sides of the second table 40. Therefore, a size of the fusible toy bead creation table 10 in the left-right direction can be made compact, and it is possible to implement a fusible toy bead creation table that can save space.

According to the embodiment of the present disclosure described above, it is possible to provide a creation table for fusible toy bead of the following aspects.

A creation table for fusible toy bead according to a first aspect includes: a first table having a plurality of through holes extending in a penetration direction and configured to allow a fusible toy bead to be placed on one side of the plurality of through holes in the penetration direction; and a second table including a plurality of pins configured to be inserted into and removed from the plurality of through holes from another side of the plurality of through holes in the penetration direction, in which: the first table is configured to be stacked on the second table in a first direction along a normal direction of the second table such that the plurality of pins are inserted into the plurality of through holes, the first table including at least one protruding portion protruding in the first direction; the second table includes at least one lug portion connected via a hinge so as to be foldable in the first direction; and the at least one lug portion is engaged with the at least one protruding portion by folding the at least one lug portion in the first direction in a state where the first table is stacked on the second table.

According to this configuration, when the creation table for fusible toy bead is not used, by stacking the first table on the second table in the first direction and folding the lug portion of the second table in the first direction, the lug portion can be engaged with the protruding portion of the first table. Accordingly, since the first table and the second table are engaged with each other and the lug portion can be held in a state of being folded in the first direction which is a protruding direction of the protruding portion, it is possible to implement a creation table for fusible toy bead that can save space.

In the creation table for fusible toy bead according to a second aspect, the at least one lug portion includes a surface, and the surface defines, in a state where the at least one lug portion is not being folded in the first direction, an inclined surface that is inclined from a region where the plurality of pins of the second table are provided to an installation surface on which the second table is installed.

According to this configuration, in a state where the first table is stacked on the second table in the first direction and the plurality of pins are inserted into the plurality of through holes, by not folding the lug portion, unused fusible toy beads placed on the pins can be easily rolled onto the installation surface via the inclined surface of the lug portion.

In the creation table for fusible toy bead according to a third aspect, the at least one protruding portion has an engagement protrusion protruding in a second direction substantially perpendicular to the first direction, and the engagement protrusion is engaged with the at least one lug portion by folding the at least one lug portion in the first direction in a state where the first table is stacked on the second table.

According to this configuration, since the lug portion is engaged with the protruding portion in the second direction different from the first direction in which the lug portion is folded, it is possible to provide a specific configuration regarding an engagement mode of the lug portion and the protruding portion in which space saving can be achieved.

In the creation table for fusible toy bead according to a forth aspect, the at least one protruding portion includes two protruding portions, and the two protruding portions are situated on both sides of the at least one lug portion, respectively, to sandwich the at least one lug portion in the second direction in a state where the first table is stacked on the second table and the at least one lug portion is folded in the first direction.

According to this configuration, since the lug portion is engaged with the protruding portions on both sides, the engagement mode between the lug portion and the protruding portions can be strengthened while saving space.

In the creation table for fusible toy bead according to a fifth aspect, the at least one lug portion includes a first lug portion and a second lug portion, and the first lug portion and the second lug portion are provided on both sides of the second table in a third direction substantially perpendicular to the first direction and the second direction, respectively, the at least one protruding portion includes: two first protruding portions provided on one side of the first table in the third direction; and two second protruding portions provided on another side of the first table in the third direction, the two first protruding portions are situated on both sides of the first lug portion, respectively, to sandwich the first lug portion in the second direction in a state where the first table is stacked on the second table and the first lug portion is folded in the first direction, and the two second protruding portions are situated on both sides of the second lug portion, respectively, to sandwich the second lug portion in the second direction in a state where the first table is stacked on the second table and the second lug portion is folded in the first direction.

According to this configuration, since the lug portion is engaged with the protruding portions on both sides, the engagement mode between the lug portion and the protruding portions can be strengthened while saving space. Further, since a plurality of engagement points between the lug portions and the protruding portions can be provided, the engagement between the first table and the second table can be made stronger.

In the creation table for fusible toy bead according to a sixth aspect, the at least one lug portion includes two lug portions provided on both sides of the second table in a third direction substantially perpendicular to the first direction and the second direction, respectively, and the at least one protruding portion includes two protruding portions provided on both sides of the first table in the third direction, respectively.

According to this configuration, since a plurality of engagement points between the lug portions and the protruding portions can be provided, the engagement between the first table and the second table can be made stronger.

Although the embodiment of the present disclosure has been described above, the present disclosure is not limited to the above embodiment, and various modifications can be made without departing from the scope thereof.

What is claimed is:

1. A creation table for at least one fusible toy bead comprising:

a first table having a plurality of through holes extending in a penetration direction and configured to allow a fusible toy bead to be placed on one side of the plurality of through holes in the penetration direction; and a second table including a plurality of pins configured to be inserted into and removed from the plurality of through holes from another side of the plurality of through holes in the penetration direction, wherein the first table is configured to be stacked on the second table in a first direction along a normal direction of the second table such that the plurality of pins are inserted into the plurality of through holes, the first table comprising at least one protruding portion protruding in the first direction, wherein the second table comprises at least one lug portion connected via a hinge so as to be foldable in the first direction, and wherein the at least one lug portion is engaged with the at least one protruding portion by folding the at least one lug portion in the first direction in a state where the first table is stacked on the second table.

2. The creation table for the at least one fusible toy bead according to claim 1, wherein the at least one lug portion comprises a surface, and the surface defines, in a state where the at least one lug portion is not being folded in the first direction, an inclined surface that is inclined from a region where the plurality of pins of the second table are provided to an installation surface on which the second table is installed.

3. The creation table for the at least one fusible toy bead according to claim 1, wherein the at least one protruding portion has an engagement protrusion protruding in a second direction substantially perpendicular to the first direction, and wherein the engagement protrusion is engaged with the at least one lug portion by folding the at least one lug portion in the first direction in a state where the first table is stacked on the second table.

4. The creation table for the at least one fusible toy bead according to claim 3, wherein the at least one protruding portion comprises two protruding portions, and a first protruding portion of the two protruding portions is situated on a front side of the at least one lug portion, and a second protruding portion of the two protruding portions is situated on a rear side of the at least one lug portion so as to sandwich the at least one lug portion in the second direction in a state where the first table is stacked on the second table and the at least one lug portion is folded in the first direction.

5. The creation table for the at least one fusible toy bead according to claim 3, wherein the at least one lug portion comprises a first lug portion and a second lug portion, and the first lug portion is provided on a left side of the second table in a third direction substantially perpendicular to the first direction and the second direction and the second lug portion is provided on a right side of the second table in the third direction, wherein the at least one protruding portion comprises: two first protruding portions provided on a left side of the first table in the third direction; and two second protruding portions provided on a right side of the first table in the third direction, wherein one of the two first protruding portions is situated on a front side of the first lug portion and an other of the two first protruding portions is situated on the rear side of the first lug portion to sandwich the first lug portion in the second direction in a state where the first table is stacked on the second table and the first lug portion is folded in the first direction, and wherein one of the two second protruding portions is situated on a front side of the second lug portion and an other of the two second protruding portions is situated on the rear side of the second lug portion to sandwich the second lug portion in the second direction in a state where the first table is stacked on the second table and the second lug portion is folded in the first direction.

6. The creation table for the at least one fusible toy bead according to claim 3, wherein the at least one lug portion comprises a first lug portion and a second lug portion, the first lug portion is provided on a left side of the second table in a third direction substantially perpendicular to the first direction and the second direction and the second lug portion is provided on a right side of the second table in the third direction, and wherein the at least one protruding portion comprises two protruding portions, a first protruding portion of the two protruding portions is provided on a left side of the first table in the third direction and a second protruding portion of the two protruding portions is provided on a right side of the of the first table in the third direction.

* * * * *